US008692478B2

(12) United States Patent
Xu et al.

(10) Patent No.: US 8,692,478 B2
(45) Date of Patent: Apr. 8, 2014

(54) CURRENT BALANCING CIRCUIT

(75) Inventors: Lizhi Xu, Shanghai (CN); Weiqiang Zhang, Shanghai (CN); Jianping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 264 days.

(21) Appl. No.: 13/242,123

(22) Filed: Sep. 23, 2011

(65) Prior Publication Data

US 2012/0293080 A1 Nov. 22, 2012

(30) Foreign Application Priority Data

May 20, 2011 (CN) ..... 2011 1 0133497

(51) Int. Cl.
*H05B 41/16* (2006.01)

(52) U.S. Cl.
USPC ..... 315/282; 315/276; 315/185 S; 315/247; 315/312

(58) Field of Classification Search
CPC ..... H05B 41/2827
USPC ..... 315/274–289, 247, 185 S, 291, 307, 315/312–326
See application file for complete search history.

(56) References Cited

U.S. PATENT DOCUMENTS

| | | | | |
|---|---|---|---|---|
| 7,053,560 | B1 * | 5/2006 | Ng | 315/185 R |
| 2006/0255753 | A1 * | 11/2006 | Sawada et al. | 315/312 |
| 2008/0067944 | A1 * | 3/2008 | Wang et al. | 315/185 R |

* cited by examiner

*Primary Examiner* — Tuyet Thi Vo
(74) *Attorney, Agent, or Firm* — Kirton McConkie; Evan R. Witt

(57) ABSTRACT

The invention provides a current balancing circuit, which includes a plurality of light-emitting diode assemblies; an AC power generator for providing currents required by the light-emitting diode assemblies; and a plurality of current-equaling elements connected to the AC power generator, each of which is connected to a common mode connecting two light-emitting diode assemblies for balancing currents of the light-emitting diode assemblies.

18 Claims, 5 Drawing Sheets

CURRENT BALANCING CIRCUIT

FIELD OF THE INVENTION

The invention relates to a current balancing circuit, and more particularly to a current balancing circuit for balancing currents flowing through a plurality of light-emitting diode (LED) assemblies.

BACKGROUND OF THE INVENTION

Recently, with the breakthrough advancement of the manufacturing technique of light-emitting diodes (LEDs), the luminance and efficiency of the light-emitting diodes are greatly improved. The LED has replaced old fluorescent lamps as the illuminating device of the next generation. Nowadays, the LED has been widely employed in the applications of home illuminating appliances, car illuminating devices, handheld illuminating devices, the backlight source of LCD panels, traffic signal indicators, and billboards. In order to increase the luminance of the LED, a number of LEDs are connected in series to form a LED assembly.

LEDs are generally DC loads. In the application where a number of parallel-connected LED assemblies are employed, the current flowing through the LED assemblies are different from each other as the characteristics and impedance of each LED are different from each other. If the currents flowing through the LED assemblies are not balanced, the luminance will not be uniform and the longevity of respective LED will be shortened. This would further impair the electronic device.

In order to tackle the problem that the currents of the LED assemblies are not uniform, several current balancing techniques have been proposed to address this problem. One of such techniques is to employ independent drivers to individually drive each LED assembly. However, such independent driver will complicate the circuitry and increase the manufacturing cost. More disadvantageously, the current balancing effect is bad as the driver has tolerance. Another state-of-the-art current balancing technique is to use a common choke to equal the currents flowing through the LED assemblies. Nonetheless, using a plurality of common chokes will increase the number of magnetic elements in the circuitry, and thus the manufacturing cost is elevated and the size of the circuitry is expanded. More disadvantageously, the current balancing effect is also bad as the common choke will induce a magnetizing current.

Hence, it is needed to develop a current balancing circuit for addressing the aforementioned problems encountered by the prior art.

SUMMARY OF THE INVENTION

The primary object of the invention is to provide a current balancing circuit for balancing the currents flowing through a plurality of LED assemblies, thereby addressing the problem encountered by the prior art.

To this end, the invention provides a current balancing circuit, including a plurality of light-emitting diode assemblies, which includes a first light-emitting diode assembly; a second light-emitting diode assembly connected to the first light-emitting diode assembly in parallel in reverse order, and connected with the first light-emitting diode assembly through a first common node; and a third light-emitting diode assembly connected to the second light-emitting diode assembly in parallel in reverse order, and connected with the second light-emitting diode assembly through a second common node. The current balancing circuit also includes an AC power generator for providing currents required by the first light-emitting diode assembly, the second light-emitting diode assembly, and the third light-emitting diode assembly. The current balancing circuit also includes a plurality of current-equaling elements, which includes a first current-equaling element connected between the AC power generator and the first common node for balancing the current of the first light-emitting diode assembly and the current of the second light-emitting diode assembly, and a second current-equaling element connected between the AC power generator and the second common node for balancing the current of the second light-emitting diode assembly and the current of the third light-emitting diode assembly.

Now the foregoing and other features and advantages of the invention will be best understood through the following descriptions with reference to the accompanying drawings, in which:

DESCRIPTION OF THE PREFERRED EMBODIMENT

Several exemplary embodiments embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 1:
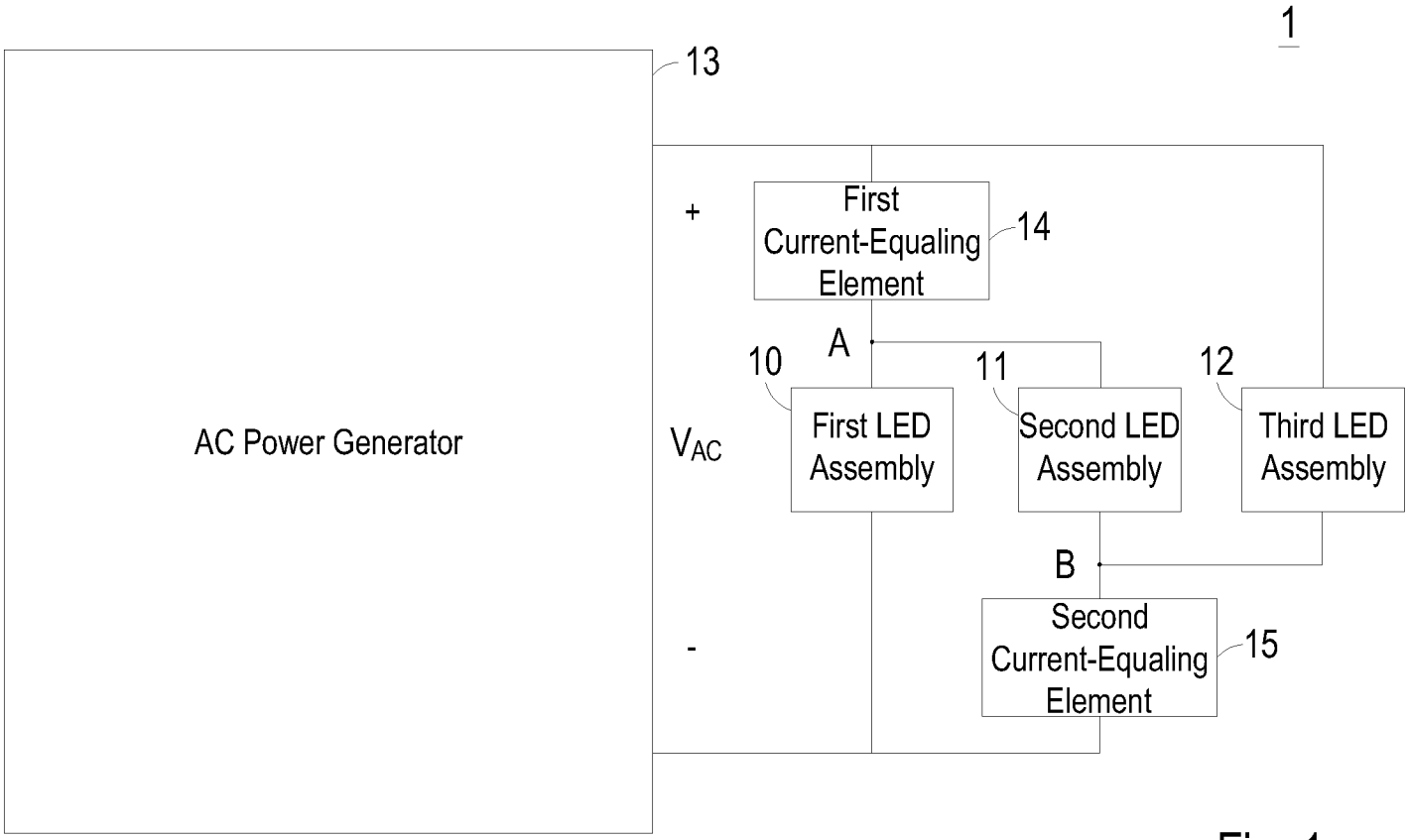
FIG. 1 illustrates the circuit block diagram of the current balancing circuit according to a preferred embodiment of the invention.
Figure 2:
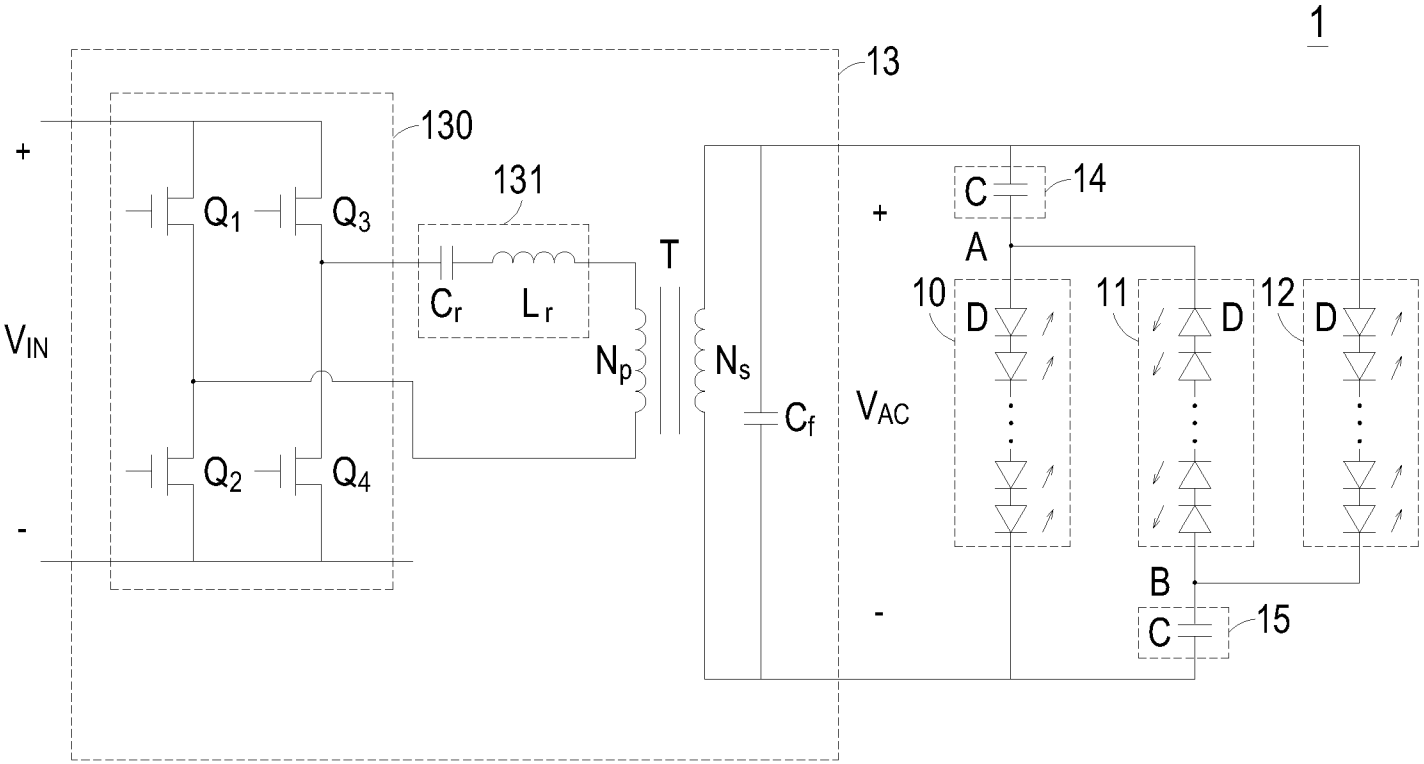
FIG. 2 illustrates the partial circuitry of the current balancing circuit of FIG. 1.

Referring to FIGS. 1 and 2, in which FIG. 1 illustrates the circuit block diagram of the current balancing circuit according to a preferred embodiment of the invention, and FIG. 2 illustrates the partial circuitry of the current balancing circuit of FIG. 1. As shown in FIGS. 1 and 2, a current balancing circuit 1 is applied to various illuminating devices, such as home illuminating devices, car illuminating devices, handheld illuminating devices, backlight source for LCD panels, traffic signal lights, and billboards. The current balancing circuit 1 includes a plurality of LED assemblies, a plurality of current-equaling elements, and an AC power generator.

In this embodiment, the number of the LED assemblies is N, where N is a positive integer and is larger than or equal to 3. The number of the current-equaling elements is less than the number of the LED assemblies by one. That is, the number of the current-equaling elements is N−1. In this embodiment, the current balancing circuit 1 includes a first LED assembly 10, a second LED assembly 11, a third LED assembly 12, a first current-equaling element 14, and a second current-equaling element 15. The first LED assembly 10, the second LED assembly 11, and the third LED assembly 12 are powered by an AC voltage $V_{AC}$ provided by the AC power generator 13. The first LED assembly 10 and the second LED assembly 11 are connected in parallel with each other in reverse order. Also, the second LED assembly 11 and the third LED assembly 12 are connected in parallel with each other in reverse order. In other words, as shown in FIG. 2, the negative terminal of the first LED assembly 10 is connected to the negative terminal of the AC power generator 13. The positive terminal of the first LED assembly 10 and the negative terminal of the second LED assembly 11 are connected to a first common node A. The positive terminal of the second LED assembly 11 and the negative terminal of the third LED assembly 12 are connected to a second common node B. The positive terminal of the third LED assembly 12 is connected to the positive terminal of the AC power generator 13.

In alternative embodiments, the first LED assembly 10, the second LED assembly 11, and the third LED assembly 12 may include a single LED or a plurality of serially-connected diodes, respectively. Also, in alternative embodiments, the connecting relationship of the positive terminals and the negative terminals of the first LED assembly 10, the second LED assembly 11, and the third LED assembly 12 may be opposite to the connecting relationship of the positive terminals and the negative terminals of the first LED assembly 10, the second LED assembly 11, and the third LED assembly 12 shown in FIG. 2.

The first current-equaling element 14 is connected between the positive terminal of the AC power generator 13 and the first common node A for balancing the current of the first LED assembly 10 and the current of the second LED assembly 11. The second current-equaling element 15 is connected between the negative terminal of the AC power generator 13 and the second common node B for balancing the current of the second LED assembly 11 and the current of the third LED assembly 12.

In the foregoing embodiments, the first current-equaling element 14 and the second current-equaling element 15 may include a capacitor, respectively. As the capacitor has the Amp-Second balance characteristic, i.e. The charge balance characteristic of the capacitor, the average current flowing through the first current-equaling element 14 and the average current flowing through the second current-equaling element 15 will both be zero. In other words, the average current flowing through the first current-equaling element 14 in forward direction will be equal to the average current flowing through the first current-equaling element 14 in reverse direction, and the average current flowing through the second current-equaling element 15 in forward direction will be equal to the average current flowing through the second current-equaling element 15 in reverse direction. Hence, the first current-equaling element 14 can balance the current of the first LED assembly 10 and the current of the second LED assembly 11, and the second current-equaling element 15 can balance the current of the second LED assembly 11 and the current of the third LED assembly 12. Thus, the current of first LED assembly 10 and the current of the second LED assembly 11 and the current of the third LED assembly 12 will be balanced simultaneously by the first current-equaling element 14 and the second current-equaling element 15. As the invention employs the physical characteristics of the capacitor to attain the current balance for a plurality of LED assemblies, the current balancing effect of the invention is much better compared to the conventional current balancing techniques of using drivers or common chokes. More advantageously, the current balancing circuit 1 of the invention has a simple circuitry, a small size, and low manufacturing cost.

In the foregoing embodiments, the AC voltage $V_{AC}$ outputs its positive half-cycle voltages and its negative half-cycle voltages through the first current-equaling element 14 to drive the first LED assembly 10 and the second LED assembly 11, respectively. Also, the AC voltage $V_{AC}$ outputs its positive half-cycle voltages and its negative half-cycle voltages through the second current-equaling element 15 to drive the third LED assembly 12 and the second LED assembly 11, respectively. Hence, the AC voltage $V_{AC}$ can alternately drive the first LED assembly 10 and the second LED assembly 11 to illuminate, and can alternately drive the second LED assembly 11 and the third LED assembly 12 to illuminate.

In alternative embodiments, the AC power generator 13 may include a commercially available power source or a generator for directly outputting the AC voltage $V_{AC}$, as shown in FIG. 1. In alternative embodiments, the AC power generator 13 may be implemented by a full-bridge resonant DC-AC converter, as shown in FIG. 2. The full-bridge resonant DC-AC converter 13 of FIG. 2 is used to receive an input voltage $V_{IN}$ and convert the input voltage $V_{IN}$ into a sinusoidal AC voltage $V_{AC}$. The full-bridge resonant DC-AC converter 13 of FIG. 2 includes a switch circuit 130, a resonant tank 131, a transformer T, and a stabilizing capacitor $C_f$. The switch circuit 130 is used to receive the input voltage $V_{IN}$ and includes a plurality of switch elements $Q_1$-$Q_4$. The switch elements ($Q_1$, $Q_2$) and the switch elements ($Q_3$, $Q_4$) respectively form two rectifier arms. The driving signals received by the switch elements ($Q_1$, $Q_4$) and the switch elements ($Q_2$, $Q_3$) (not shown) are set to drive the switch elements to conduct switching operations with their duty ratio being approximate to 50%, and the switch elements $Q_1$-$Q_4$ are set to conduct zero-voltage switching operations. The resonant tank 131 and the primary winding $N_p$ of the transformer T are connected to the intermediate nodes of the rectifier arms in the switch circuit 130. The resonant tank 131 may include a resonant capacitor $C_r$ and a resonant inductor $L_r$ connected in series with each other. The energy received by the primary winding $N_p$ of the transformer T is transformed and the transformed energy is outputted by the secondary winding $N_s$ of the transformer T. The filtering capacitor $C_f$ is connected across the secondary winding $N_s$ of the transformer T for filtering and stabilizing the energy outputted by the secondary winding $N_s$, thereby generating the AC voltage $V_{AC}$.

Figure 3:
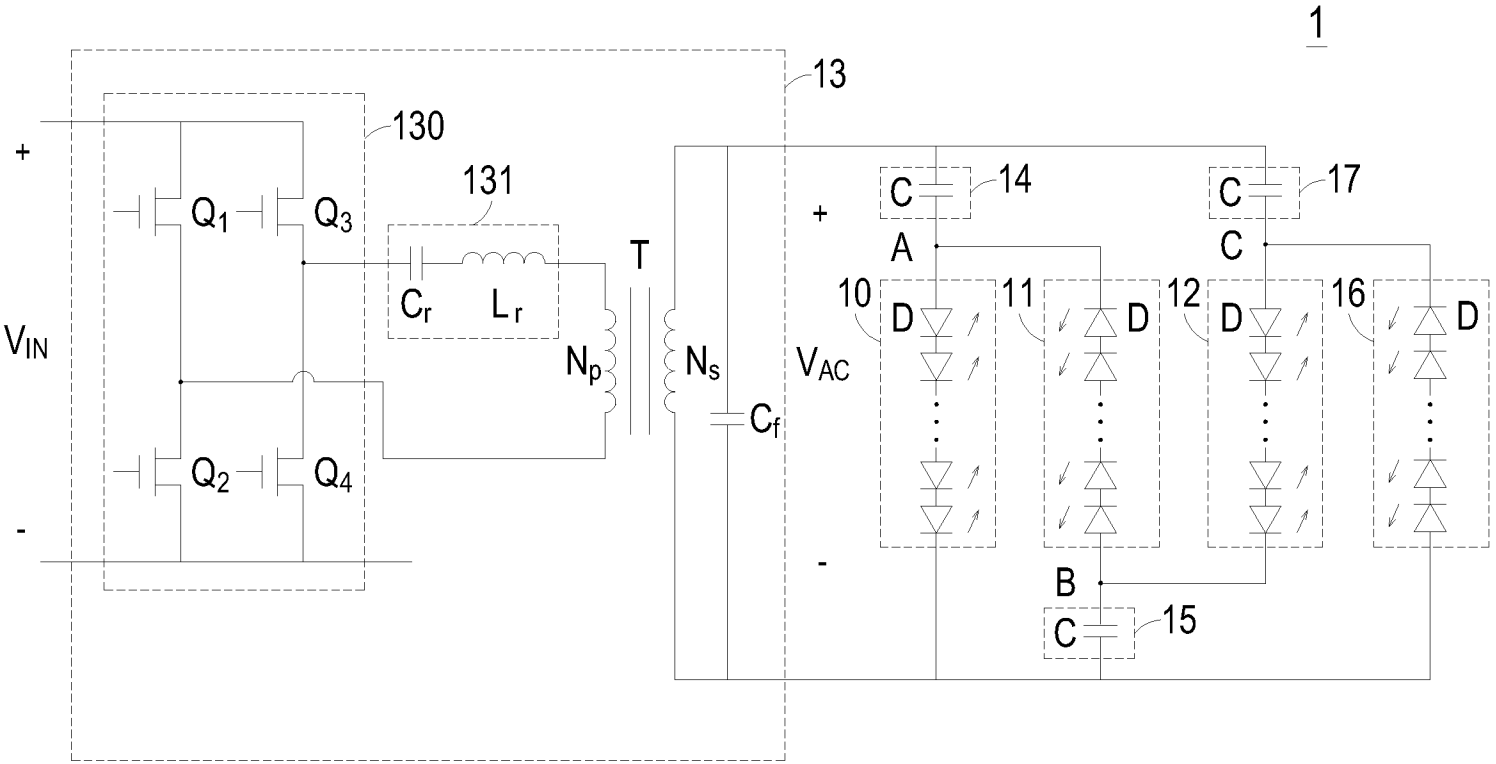
FIG. 3 illustrates the circuitry of the current balancing circuit of FIG. 2 with an additional LED assembly incorporated in the circuitry.

Certainly, the number of the LED assemblies in the current balancing circuit 1 of the invention may not be limited to three as shown in FIGS. 1 and 2. As shown in FIG. 3, the current balancing circuit 1 includes an fourth LED assembly 16 in addition to the first LED assembly 10, the second LED assembly 11, and the third LED assembly 12. The fourth LED assembly 16 is connected in parallel with the third LED assembly 12 in reverse order. That is, the positive terminal of the fourth LED assembly 16 is connected to the negative terminal of the AC power generator 13, and the negative terminal of the fourth LED assembly 16 and the positive terminal of the third LED assembly 12 are connected to a third common node C. In order to balance the current of the third LED assembly 12 and the current of the fourth LED assembly 16, the current balancing circuit 1 further includes a third current-equaling element 17 which is connected between the positive terminal of the AC power generator 13 and the third common terminal C and may include a capacitor C. It can be understood that the LED assemblies in the current balancing circuit 1 may be three or more, in which each LED assembly is connected to another LED assembly in parallel in reverse order and both are set to illuminate alternately. Also, the number of the current-equaling elements is less than the number of the LED assemblies by one, thereby allowing a plurality of current-equaling elements to balance the currents of a plurality of LED assemblies.

Figure 4:
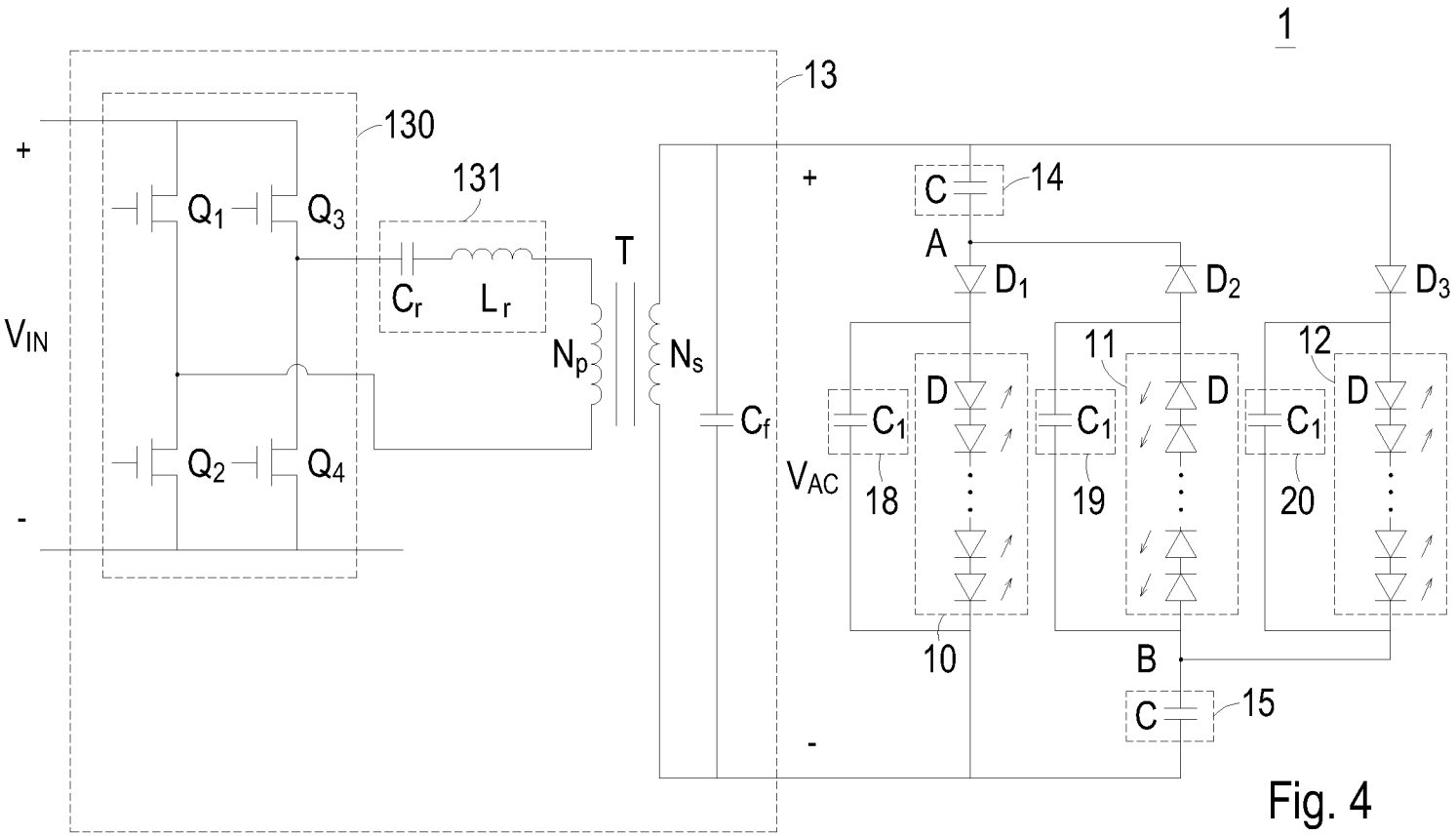
FIG. 4 illustrates a modified circuitry of the current balancing circuit of FIG. 2.

In the alternative embodiment of FIG. 4, the current balancing circuit 1 may include a plurality of rectifying diodes, such as a first rectifying diode $D_1$, a second rectifying diode $D_2$, and a third rectifying diode $D_3$ which are respectively corresponding to the LED assemblies. The current balancing circuit 1 may include a plurality of filter circuits, such as a first filter circuit 18, a second filter circuit 19, and a third filter circuit 20. The first filter circuit 18, the second filter circuit 19, and the third filter circuit 20 may include a capacitor $C_1$ and may be connected in parallel with the first LED assembly 10, the second LED assembly 11, and the third LED assembly 12, respectively. The first filter circuit 18, the second filter circuit 19, and the third filter circuit 20 are used to filter the abnormal pulse voltages and store the energy supplied by the AC voltage $V_{AC}$. In case that the first LED assembly 10, the second LED assembly 11, or the third LED assembly 12 are put out during the positive half-cycle or the negative half-cycle of the AC voltage $V_{AC}$, the first filter circuit 18, the second filter circuit 19, and the third filter circuit 20 are respectively set to supply the stored energy to the first LED assembly 10, the second LED assembly 11, or the third LED assembly 12, thereby preventing the first LED assembly 10, the second LED assembly 11, or the third LED assembly 12 from being put out. Therefore, the LED D in the first LED assembly 10, the second LED assembly 11, and the third LED assembly 12 can be free from the repetitive alternate dimming operations by the first filter circuit 18, the second filter circuit 19, and the third filter circuit 20. Thus, the longevity of the LED D is prolonged.

The first rectifying diode $D_1$ and the first LED assembly 10 are connected in series with each other in forward order. The second rectifying diode $D_2$ and the second LED assembly 11 are connected in series with each other in forward order. The third rectifying diode $D_3$ and the third LED assembly 12 are connected in series with each other in forward order. The first rectifying diode $D_1$, the second rectifying diode $D_2$, and the third rectifying diode $D_3$ are used to prevent the first LED assembly 10, the second LED assembly 11, and the third LED assembly 12 from being infiltrated by the bidirectional current when the AC voltage $V_{AC}$ is outputting positive half-cycle voltages or negative half-cycle voltages. Thus, the current balance among the first LED assembly 10, the second LED assembly 11, and the third LED assembly 12 can be ensured.

Figure 5:
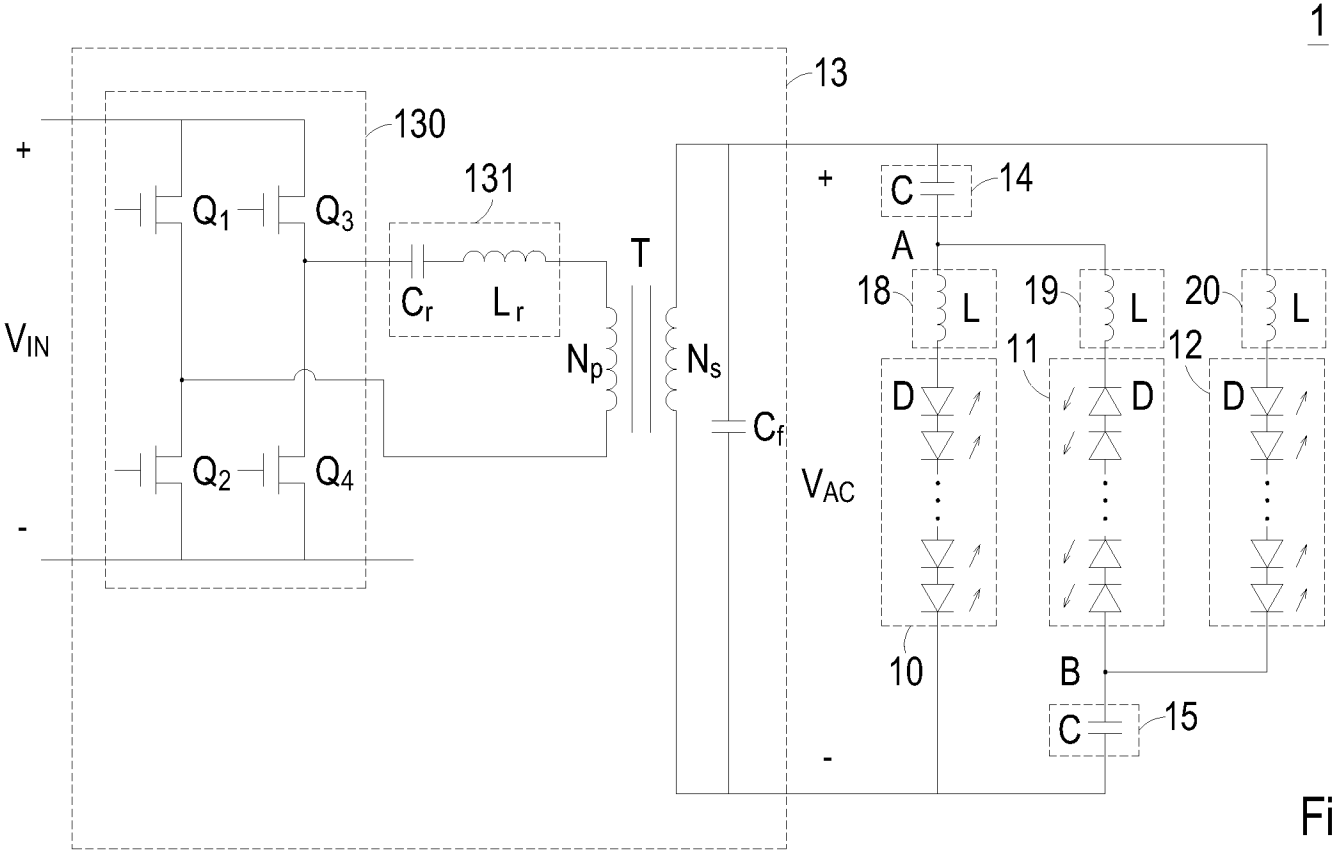
FIG. 5 illustrates another modified circuitry of the current balancing circuit of FIG. 2.

Certainly, the first filter circuit 18, the second filter circuit 19, and the third filter circuit 20 of FIG. 4 are not limited to be implemented by the capacitor $C_1$. In the alternative embodiment of FIG. 5, the first filter circuit 18, the second filter circuit 19, and the third filter circuit 20 may be implemented by an inductor L. In case that the first filter circuit 18, the second filter circuit 19, and the third filter circuit 20 are implemented by the inductor L, the first filter circuit 18, the second filter circuit 19, and the third filter circuit 20 are connected in series with the first LED assembly 10, the second LED assembly 11, and the third LED assembly 12, respectively. Under this condition, the first filter circuit 18, the second filter circuit 19, and the third filter circuit 20 of FIG. 5 can achieve similar filtering effect with the first filter circuit 18, the second filter circuit 19, and the third filter circuit 20 of FIG. 4. Also, in case that the first filter circuit 18, the second filter circuit 19, and the third filter circuit 20 are implemented by the inductor L, as shown in FIG. 5, the first rectifying diode $D_1$, the second rectifying diode $D_2$, and the third rectifying diode $D_3$ may be kept in the circuitry, as shown in FIG. 4, or removed from the circuitry, as shown in FIG. 5.

In conclusion, the current balancing circuit of the invention employs a plurality of current-equaling elements made up of capacitors to balance the currents flowing through the LED assemblies. Therefore, the invention is advantageous over the prior art in terms of simplified circuitry, low manufacturing cost, and small size.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A current balancing circuit, comprising:

a plurality of light-emitting diode assemblies, at least comprising:

a first light-emitting diode assembly;

a second light-emitting diode assembly connected to the first light-emitting diode assembly in parallel in reverse order, and connected with the first light-emitting diode assembly through a first common node; and a third light-emitting diode assembly connected to the second light-emitting diode assembly in parallel in reverse order, and connected with the second light-emitting diode assembly through a second common node;

an AC power generator for providing currents required by the first light-emitting diode assembly, the second light-emitting diode assembly, and the third light-emitting diode assembly; and a plurality of current-equaling elements, at least comprising:

a first current-equaling element connected between the AC power generator and the first common node for balancing a current of the first light-emitting diode assembly and a current of the second light-emitting diode assembly; and a second current-equaling element connected between the AC power generator and the second common node for balancing a current of the second light-emitting diode assembly and a current of the third light-emitting diode assembly.

2. The current balancing circuit according to claim 1 wherein the first light-emitting diode assembly, the second light-emitting diode assembly, and the third light-emitting diode assembly are respectively formed by a single light-emitting diode or a plurality of light-emitting diode connected in series with each other.

3. The current balancing circuit according to claim 1 wherein the first light-emitting diode assembly and the second light-emitting diode assembly are set to illuminate alternately, and the second light-emitting diode assembly and the third light-emitting diode assembly are set to illuminate alternately.

4. The current balancing circuit according to claim 1 wherein the first current-equaling element and the second current-equaling element are respectively implemented by a capacitor.

5. The current balancing circuit according to claim 1 wherein the AC power generator includes a commercially available power source or a generator.

6. The current balancing circuit according to claim 1 wherein the number of the current-equaling elements is less than the number of the light-emitting diode assemblies by one.

7. The current balancing circuit according to claim 1 further comprising a plurality of filter circuits, each of which is correspondingly connected to the first light-emitting diode assembly, the second light-emitting diode assembly, or the third light-emitting diode assembly for filtering abnormal pulse voltages.

8. The current balancing circuit according to claim 7 wherein each filter circuit includes an inductor, and each filter circuit is correspondingly connected in series with the first light-emitting diode assembly, the second light-emitting diode assembly, or the third light-emitting diode assembly.

9. The current balancing circuit according to claim 7 wherein each filter circuit includes a capacitor, and each filter circuit is correspondingly connected in parallel with the first light-emitting diode assembly, the second light-emitting diode assembly, or the third light-emitting diode assembly.

10. The current balancing circuit according to claim 9 further comprising a plurality of rectifying diodes, each rectifying diode is correspondingly connected in series with the first light-emitting diode assembly, the second light-emitting diode assembly, or the third light-emitting diode assembly in forward order.

11. The current balancing circuit according to claim 1 wherein the AC power generator includes a full-bridge resonant DC-AC converter.

12. The current balancing circuit according to claim 11 wherein the AC power generator includes a switch circuit for receiving an input voltage.

13. The current balancing circuit according to claim 12 wherein the switch circuit includes a plurality of switch elements operating in a zero-voltage switching configuration.

14. The current balancing circuit according to claim 12 wherein the AC power generator further includes a resonant tank connected to the switch circuit.

15. The current balancing circuit according to claim 14 wherein the resonant tank includes a resonant capacitor and a resonant inductor connected in series with each other.

16. The current balancing circuit according to claim 14 wherein the AC power generator further includes a transformer having a primary winding connected to the resonant tank and the switch circuit.

17. The current balancing circuit according to claim 16 wherein the AC power generator further includes a stabilizing capacitor connected across a secondary winding of the transformer for filtering and stabilizing energy outputted by the secondary winding of the transformer, thereby generating an AC voltage.

18. A current balancing circuit, comprising:

a plurality of light-emitting diode assemblies, wherein the number of the light-emitting diode assemblies is larger than or equal to three;

an AC power generator for providing currents required by the light-emitting diode assemblies;

a plurality of current-equaling elements, wherein the number of the current-equaling elements is less than the number of the light-emitting diode assemblies by one, and each current-equaling element is set to balance currents of two light-emitting diode assemblies;

wherein each current-equaling element is connected between the AC power generator and two light-emitting diode assemblies, and at least one of the light-emitting diode assemblies is connected to two current-equaling elements;

wherein each current-equaling element includes a capacitor.

* * * * *